US010907592B2

(12) United States Patent
Miyabe et al.

(10) Patent No.: US 10,907,592 B2
(45) Date of Patent: Feb. 2, 2021

(54) VAPORIZED FUEL TREATMENT DEVICE AND LEARNING METHOD OF VALVE OPENING START POSITION OF SEALING VALVE IN VAPORIZED FUEL TREATMENT DEVICE

(71) Applicant: AISAN KOGYO KABUSHIKI KAISHA, Obu-shi, Aichi-ken (JP)

(72) Inventors: Yoshikazu Miyabe, Obu (JP); Keita Fukui, Toyota (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 189 days.

(21) Appl. No.: 16/072,438

(22) PCT Filed: Jan. 16, 2017

(86) PCT No.: PCT/JP2017/001227
§ 371 (c)(1),
(2) Date: Jul. 24, 2018

(87) PCT Pub. No.: WO2017/130769
PCT Pub. Date: Aug. 3, 2017

(65) Prior Publication Data

US 2019/0032613 A1 Jan. 31, 2019

(30) Foreign Application Priority Data

Jan. 27, 2016 (JP) ..... 2016-013419

(51) Int. Cl.
*F02M 37/00* (2006.01)
*F02D 41/24* (2006.01)
(Continued)

(52) U.S. Cl.
CPC ..... *F02M 37/0023* (2013.01); *F02D 41/004* (2013.01); *F02D 41/2429* (2013.01);
(Continued)

(58) Field of Classification Search
CPC ..... F02M 37/0023; F02M 25/0836; F02M 25/089; F02M 25/0827; F02M 25/08;
(Continued)

(56) References Cited

U.S. PATENT DOCUMENTS

2004/0200460 A1 10/2004 Mitani et al.
2011/0247595 A1 10/2011 Ogita et al.
(Continued)

FOREIGN PATENT DOCUMENTS

JP 2003-328867 11/2003
JP 2004-270573 9/2004
(Continued)

*Primary Examiner* — Joseph J Dallo
*Assistant Examiner* — Scott A Reinbold
(74) *Attorney, Agent, or Firm* — Finnegan, Henderson, Farabow, Garrett & Dunner, LLP

(57) ABSTRACT

A vaporized fuel treatment device includes a sealing valve disposed in a vapor passage between a fuel tank and a canister. An ECU is programmed to decrease an internal pressure of the fuel tank by a pump via the canister so as to diagnose whether leakage occurs in the vapor passage in a state where the communication between the canister and the atmosphere is cut off and the sealing valve is opened. The ECU is programmed to execute a learning of a valve opening start position of the sealing valve based on a change in the internal pressure of the fuel tank when changing an axial distance between valve element and a valve seat when the internal pressure of the fuel tank is equal to or smaller than a predetermined value after a diagnosis of leakage in the vapor passage.

5 Claims, 2 Drawing Sheets

(51) Int. Cl.
*F02M 25/08* (2006.01)
*F02D 41/00* (2006.01)

(52) U.S. Cl.
CPC ..... *F02D 41/2464* (2013.01); *F02M 25/08* (2013.01); *F02M 25/089* (2013.01); *F02M 25/0827* (2013.01); *F02M 25/0836* (2013.01)

(58) Field of Classification Search
CPC ..... F02M 21/0239; F02M 37/0029; F02M 59/366; F02M 69/54; F02D 41/2464; F02D 41/004; F02D 41/2429
USPC ..... 123/511
See application file for complete search history.

(56) References Cited

U.S. PATENT DOCUMENTS

| | | | | |
|---|---|---|---|---|
| 2015/0159566 | A1* | 6/2015 | Akita | F02D 41/003 137/488 |
| 2015/0159567 | A1* | 6/2015 | Akita | F02D 41/003 137/624.27 |
| 2015/0330338 | A1* | 11/2015 | Ito | F02M 25/0836 123/520 |

FOREIGN PATENT DOCUMENTS

| | | |
|---|---|---|
| JP | 2010-216287 | 9/2010 |
| JP | 2010216287 A * | 9/2010 |
| JP | 2011-226401 | 11/2011 |
| JP | 2015-045264 | 3/2015 |
| JP | 2015-102009 | 6/2015 |
| JP | 2015-110914 | 6/2015 |
| JP | 2015-218659 | 12/2015 |

* cited by examiner

VAPORIZED FUEL TREATMENT DEVICE AND LEARNING METHOD OF VALVE OPENING START POSITION OF SEALING VALVE IN VAPORIZED FUEL TREATMENT DEVICE

This is a national phase application of PCT/JP2017/1227 filed Jan. 16, 2017, claiming priority to Japanese Patent Application No. JP2016-13419 filed Jan. 27, 2016, the contents of which are incorporated herein by reference.

TECHNICAL FIELD

The present disclosure relates to a vaporized fuel treatment device with a sealing valve disposed in a vapor passage between a fuel tank and a canister and a learning method of a valve opening start position of the sealing valve in the vaporized fuel treatment device.

BACKGROUND

A conventionally known vaporized fuel treatment device includes a sealing valve that is driven by a stepper motor and controller that executes a learning of a valve opening start position of the sealing valve based on a change in an internal pressure of a fuel tank when changing an axial distance between a valve element and a valve seat of the sealing valve (as shown in, for example, Patent Literature 1). The controller of the vaporized fuel treatment device moves the valve element by a predetermined stroke at predetermined intervals from a valve closing limit position of the sealing valve and determines whether or not an internal pressure of the fuel tank decreases by a predetermined value or more with respect to a last detected value. Then, the controller judges that the sealing valve starts opening when determining that the internal pressure of the fuel tank decreases by the predetermined value or more with respect to the last detected value and calculates a learning value of the valve opening start position based on a total stroke from the valve closing limit position. Further, the controller determines whether or not an increase amount of the internal pressure of the fuel tank is permissible and interrupts or inhibits the learning of the valve opening start position when determining that the increase amount of the internal pressure of the fuel tank is not permissible during or before the learning.

CITATION LIST

Patent Literature

PTL1: Japanese Patent Application Laid Open No. 2015-110914

SUMMARY

A detected value of a sensor that detects the internal pressure of the fuel tank changes in accordance with both a vaporization state of fuel in the fuel tank and a behavior of a vehicle including the vaporized fuel treatment device or a behavior of fuel in the fuel tank. Thus, the learning of the valve opening start position of the sealing valve may be inhibited or interrupted after a start of the learning when the internal pressure (detected value) of the fuel tank changes due to a change in the behavior of fuel in accordance with a movement of the vehicle. Hence, there still remains problems in securing opportunities for the learning of the valve opening start position in the above conventional vaporized fuel treatment device.

A subject matter of the disclosure is to increase opportunities for the learning of the valve opening start position.

The disclosure is directed to a vaporized fuel treatment device configured to include a sealing valve that is disposed in a vapor passage between a fuel tank and a canister and is configured to include a valve element that moves forward and backward in an axial direction with respect to a valve seat, a cut-off valve configured to cut off a communication between the canister and an atmosphere, and a pressure reduction pump configured to reduce an internal pressure of the canister. The vaporized fuel treatment device further includes a vapor passage diagnostic module programmed to decrease an internal pressure of the fuel tank by the pressure reduction pump via the canister so as to diagnose whether or not leakage occurs in the vapor passage in a state where the cut-off valve cuts off the communication between the canister and the atmosphere and the sealing valve is opened, and a learning module programmed to execute a learning of a valve opening start position of the sealing valve based on a change in the internal pressure of the fuel tank when changing an axial distance between the valve element and the valve seat when the internal pressure of the fuel tank is equal to or smaller than a predetermined value after a diagnosis of leakage in the vapor passage by the vapor passage diagnostic module.

The vapor passage diagnostic module of the vaporized fuel treatment device decreases the internal pressure of the fuel tank by the pressure reduction pump via the canister so as to diagnose whether or not leakage occurs in the vapor passage in the state where the cut-off valve cuts off the communication between the canister and the atmosphere and the sealing valve is opened. Further, the learning module executes the learning of the valve opening start position of the Sealing valve when the internal pressure of the fuel tank is equal to or smaller than the predetermined value after the diagnosis of leakage in the vapor passage by the vapor passage diagnostic module. That is, the internal pressure of the fuel tank is reduced after the diagnosis of leakage in the vapor passage. Further, the learning of the valve opening start position of the sealing valve can be executed when the internal pressure of the fuel tank is equal to or smaller than the predetermined value. Accordingly, the vaporized fuel treatment device enables opportunities for the learning of the valve opening start position of the sealing valve to be effectively increased.

The vaporized fuel treatment device may further include a purge passage connected to the canister and a purge passage diagnostic module programmed to execute the internal pressure of the fuel tank by the pressure reduction pump so as to diagnose whether or not leakage occurs in the purge passage in a state where the cut-off valve cuts off the communication between the canister and the atmosphere and the sealing valve is closed. The vapor passage diagnostic module may be programmed to diagnose whether or not the leakage occurs in the vapor passage after a diagnosis of leakage in the purge passage by the purge passage diagnostic module.

The vapor passage diagnostic module may be programmed to diagnose whether or not the leakage occurs in the vapor passage when the internal pressure of the fuel tank is larger than a first threshold value that is smaller than a standard atmosphere pressure and the internal pressure of the fuel tank is smaller than a second threshold value that is larger than the standard atmosphere pressure.

The learning module may be programmed to execute the learning of the valve opening start position when the internal pressure of the fuel tank is equal to or smaller than the first threshold value and when the internal pressure of the fuel tank is equal to or larger than the second threshold value. The predetermined value may be the first threshold value.

The disclosure is further directed to a learning method of a valve opening start position of a sealing valve in a vaporized fuel treatment device configured to include the sealing valve that is disposed in a vapor passage between a fuel tank and a canister and is configured to include a valve element that moves forward and backward in an axial direction with respect to a valve seat, a cut-off valve configured to cut off a communication between the canister and an atmosphere, and a pressure reduction pump configured to reduce an internal pressure of the canister. The method includes decreasing an internal pressure of the fuel tank by the pressure reduction pump via the canister so as to diagnose whether or not leakage occurs in the vapor passage in a state where the cut-off valve cuts off the communication between the canister and the atmosphere and the sealing valve is opened, and executing a learning of a valve opening start position of the sealing valve based on a change in the internal pressure of the fuel tank when changing an axial distance between the valve element and the valve seat when the internal pressure of the fuel tank is equal to or smaller than a predetermined value after a diagnosis of leakage in the vapor passage.

The method enables opportunities for the learning of the valve opening start position to be effectively increased.

DESCRIPTION OF EMBODIMENTS

The following describes some embodiments of the disclosure with reference to drawings.

Figure 1:
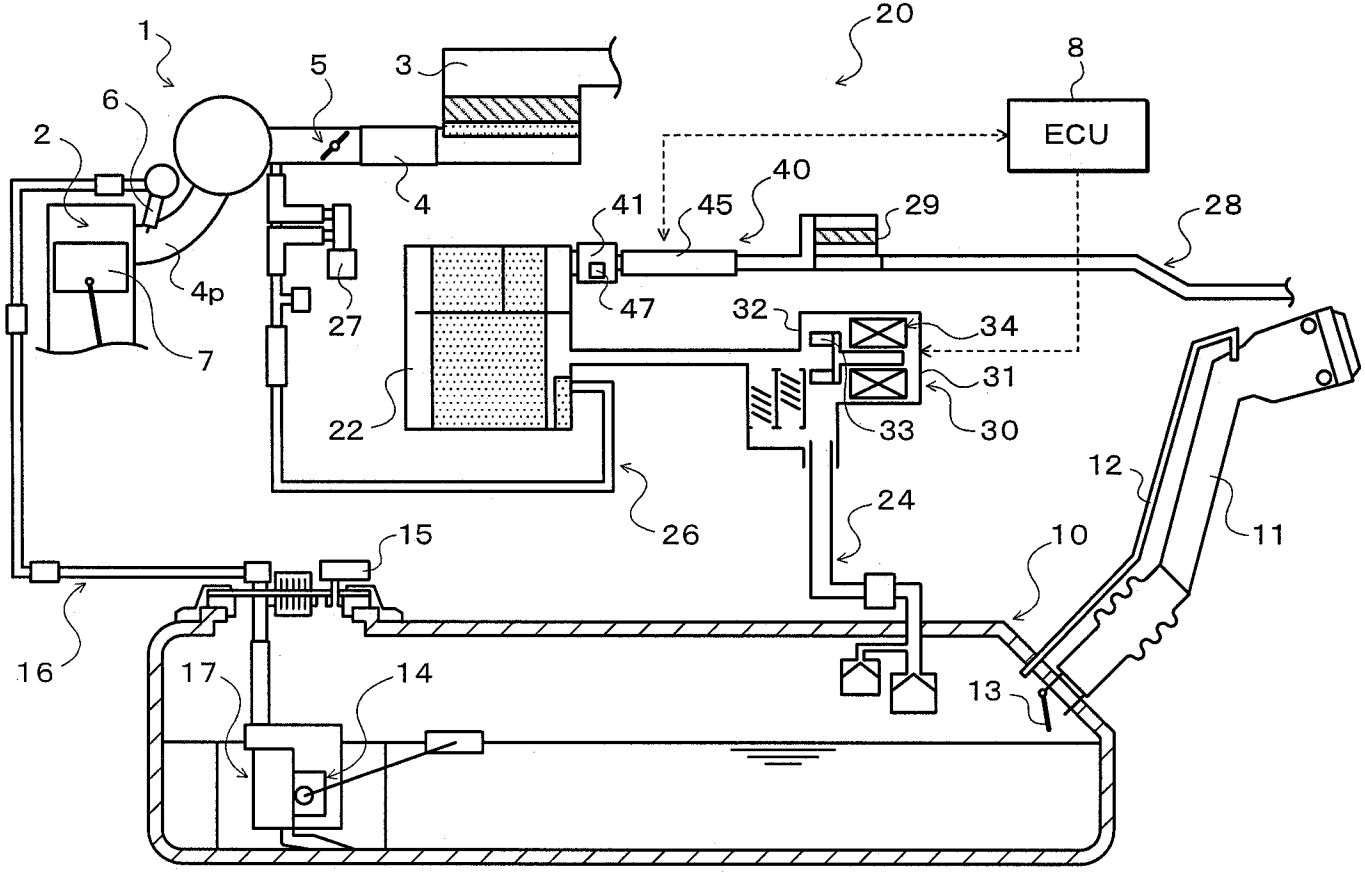
FIG. 1 is a schematic configuration diagram illustrating a vaporized fuel treatment device according to the disclosure.

FIG. 1 is a schematic configuration diagram illustrating a vaporized fuel treatment device 20 according to the disclosure. The vaporized fuel treatment device 20 illustrated in FIG. 1 is configured to prevent vaporized fuel generated in a fuel tank 10 storing fuel that is supplied to combustion chambers 2 of an engine (internal combustion engine) 1 mounted in a vehicle (not shown) from leaking outside of the fuel tank 10. In the engine 1, air cleaned by an air cleaner 3 is taken into each of the combustion chambers 2 via an intake pipe 4, a throttle valve 5, intake valves (not shown) and the like. The fuel is injected to the intake air by fuel injection valves 6 in either inlet ports 4*p* or the combustion chamber 2. Air-fuel mixture is ignited with spark generated by a spark plug (not shown) and is explosively combusted in the combustion chambers 2 so as to reciprocatingly move pistons 7. The engine 1 is controlled by an electric control unit (hereinafter referred to as "ECU") 8 that includes a microcomputer with a CPU and the like (not shown). The vehicle with the engine 1 may be either a vehicle that includes only the engine 1 as a power source generating power for driving or a hybrid vehicle that includes a motor generating power for driving in addition to the engine 1.

The fuel tank 10 is configured to include a fuel inlet pipe 11 for supplying the fuel to the fuel tank 10 via a fuel filler (not shown) of the vehicle, a vent line 12, a check valve 13 that regulates the fuel from flowing back from the fuel tank 10 to the fuel filler, a fuel sender gauge 14 that detects a surface level of the fuel in the fuel tank 10 by means of a float, a tank internal pressure sensor 15 that detects an internal pressure Ptk of the fuel tank 10 and the like. The fuel sender gauge 14 and the tank internal pressure sensor 15 respectively send a signal indicating a detected value to the ECU 8. A fuel passage 16 is connected to an upper portion of the fuel tank 10 and a fuel pump module 17 is disposed in the fuel tank 10. The fuel pump module 17 is controlled by the ECU 8 and is connected to the fuel passage 16. The fuel is pressurized by the fuel pump module 17 so as to be supplied to the fuel injection valves 6 of the engine 1 via the fuel passage 16.

As shown in FIG. 1, the vaporized fuel treatment device 20 is configured to include a canister 22, a vapor passage 24 connecting the fuel tank 10 and the canister 22, a purge passage 26, atmosphere passage 28 and a sealing valve 30 disposed in the middle of the vapor passage 24. The canister 22 includes an active charcoal or an absorbent disposed therein so as to absorb the vaporized fuel in the fuel tank 10 by means of the active charcoal. One end portion (upstream side end portion) of the vapor passage 24 is connected to the fuel tank 10 so as to communicate with a gaseous layer in the fuel tank 10. The other end portion (downstream side end portion) of the vapor passage 24 is connected to the canister 22 so as to communicate with the inside of the canister 22.

One end portion (upstream side end portion) of the purge passage 26 is connected to the canister 22 so as to communicate with the inside of the canister 22. The other end portion (downstream side end portion) of the purge passage 26 is connected to the intake pipe 4 at a downstream side of the throttle valve 5 of the engine 1. A purge valve 27 capable of cutting off the purge passage 26 is disposed in the middle of the purge passage 26. The purge valve 27 is an on-off valve that is controlled by the ECU 8 and is normally maintained in a close state. Further, one end portion of the atmosphere passage 28 is connected to the canister 22 via key-off pump module 40 or a diagnostic equipment that is used for a fault diagnosis of the vaporized fuel treatment device 20. The key-off pump module 40 is configured to include a switching valve 41 that is an on-off valve (cut-off valve) controlled by the ECU 8, a vacuum pump (pressure reduction pump) 45 controlled by the ECU 8 and a canister internal pressure sensor 47 that detects an internal pressure Pc of the canister 22 and sends the detected internal pressure Pc to the ECU 8. The switching valve 41 allows a communication between the inside of the canister 22 and the atmosphere passage 28 in an open state and cuts off the communication between the inside of the canister 22 and the atmosphere passage 28 in a close state. The vacuum pump 45 is capable of reducing the internal pressure of the canister 22 (generating a negative pressure in the canister 22) when the switching valve 41 is closed. Further, an air filter 29 is disposed in the middle of the atmosphere passage 28 and the other end portion of the atmosphere passage 28 is opened to the atmosphere.

The sealing valve 30 is a flow control valve that is controlled by the ECU 8. The sealing valve 30 seals the vapor passage 24 in a close state so as to cut off the communication between the canister 22 and the atmosphere passage 28. The sealing valve 30 regulates a flow rate of vapor flowing in the vapor passage 24 in an open state. The sealing valve 30 is configured to include casing 31, a valve seat 32 formed in the casing 31, a valve element 33 disposed in the casing 31 so as to be movable in an axial direction, and stepper motor 34 disposed in the casing 31 and connected to the valve element 33 via a valve guide (not shown). The stepper motor 34 is controlled by the ECU 8 and allows the valve element 33 to move forward and backward in the axial direction with respect to a valve seat 32. When the valve element 33 approaches the valve seat 32 in accordance with an operation of the stepper motor 34, a seal member (not shown) of the valve element 33 contacts with the valve seat 32 so as to close the sealing valve 30. When the valve element 33 moves away from the valve seat 32 in accordance with the operation of the stepper motor 34, the seal member of the valve element 33 moves away from the valve seat 32 so as to open the sealing valve 30.

In the above vaporized fuel treatment device 20, the sealing valve 30 is maintained in the close state when the vehicle is parked (when an operation of the engine 1 is stopped) so that the vaporized fuel in the fuel tank 10 dose not flow into the canister 22. When the vehicle is parked, the purge valve 27 is closed so as to maintain the purge passage 26 in a cut-off state and the switching valve 41 is opened so as to maintain the communication between the canister 22 and the atmosphere passage 28. Further, in the vaporized fuel treatment device 20, the ECU 8 is programmed to diagnose whether or not a leakage occurs in the vapor passage 24 and the purge passage 26 during a Key-off period of the vehicle in which an ignition switch (start switch) is turned off (the operation of the engine 1 is stopped).

When a predetermined learning execution condition is satisfied after the ignition switch is turned on, a learning of a valve opening start position of the sealing valve 30 is executed based on a change in the internal pressure of the fuel tank 10 when changing an axial distance between the valve element 33 and the valve seat 32. In the embodiment, the execution condition is satisfied when the internal pressure Ptk of the fuel tank 10 is equal to or smaller than a first threshold value Pa that is smaller than a standard atmosphere pressure and when the internal pressure Ptk of the fuel tank 10 is equal to or larger than a second threshold value Pb that is larger than the standard atmosphere pressure. The ECU 8 opens the purge valve 27 while maintaining the communication between the inside of the canister 22 and the atmosphere passage 28 when the vehicle is driven and a predetermined purge condition is satisfied. As a result, an intake negative pressure of the engine 1 (intake pipe 4) is introduced into the canister 22 via the purge passage 26 so that airflows into the canister 22 from the atmosphere passage 28. Further, the ECU 8 opens the sealing valve 30 so at to release the internal pressure of the fuel tank 10 when the purge valve 27 is opened and the internal pressure Ptk of the fuel tank 10 is equal to or more than a predetermined value. As a result, the vapor (vaporized fuel) in the fuel tank 10 flows into the canister 22 via the vapor passage 24 (sealing valve 30). The absorbent of the canister 22 is purged by the air flowing into the canister 22 and the like. The vaporized fuel desorbed from the absorbent is introduced to the intake pipe 4 of the engine 1 together with air and is combusted in the combustion chambers 2.

Figure 2:
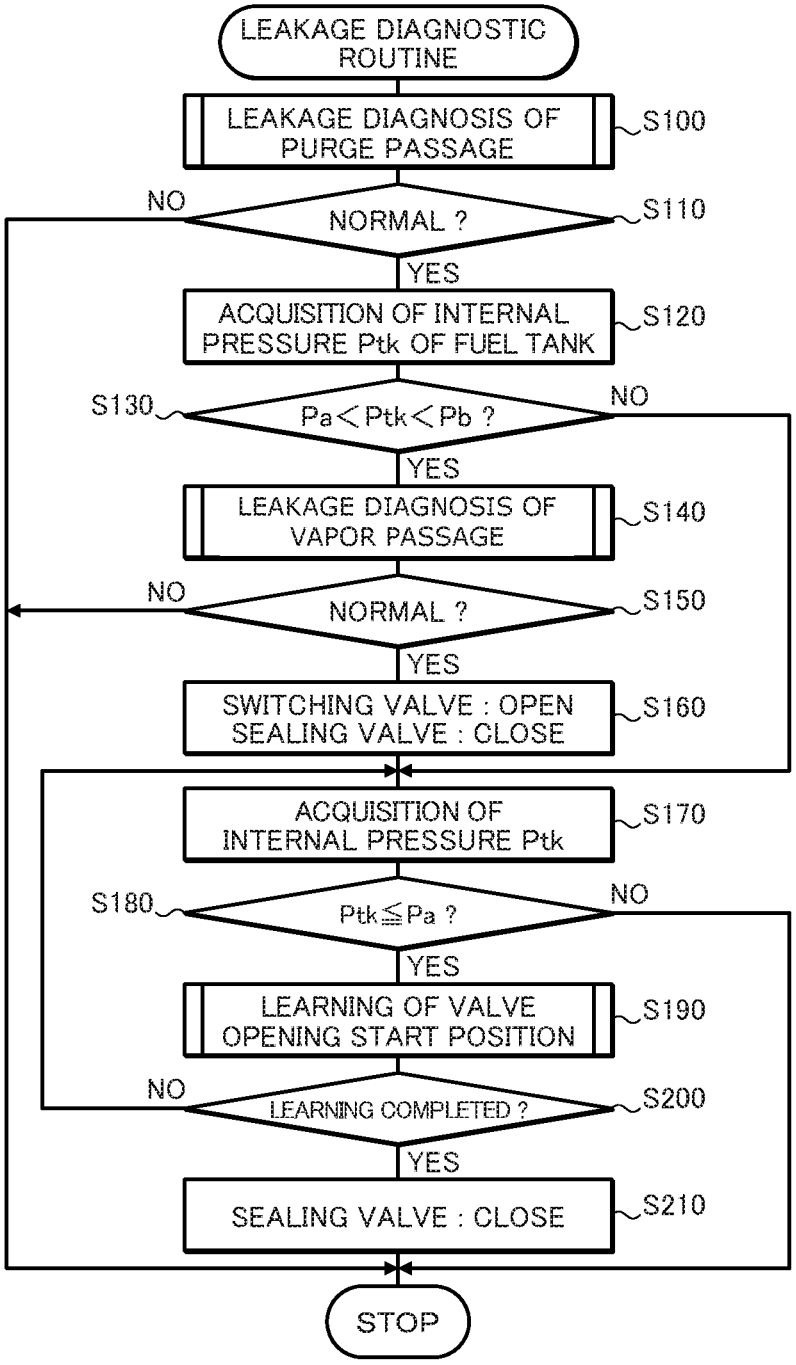
FIG. 2 is a flowchart exemplifying a leakage diagnostic routine executed in the vaporized fuel treatment device according to the disclosure.

The following describes a diagnosis of leakage in the vapor passage 24 and the purge passage 26 of the vaporized fuel treatment device 20 with reference to FIG. 2. FIG. 2 is a flowchart exemplifying a leakage diagnostic routine executed by the ECU 8.

In the embodiment, the leakage diagnostic routine of FIG. 2 is executed when an elapsed time measured by a soak timer (not shown) reaches a predetermined time (for example, several hours) after the operation of the engine 1 has been stopped. As shown in FIG. 2, the ECU 8 (CPU not shown) executes a leakage diagnosis process of the purge passage 26 (Step S100) when an execution timing of the leakage diagnosis routine is arrived. At Step S100, the ECU 8 closes the switching valve 41 of the key-off pump module 40 so as to cut off the communication between the canister 22 and the atmosphere and maintains the purge valve 27 and the sealing valve 30 in the close state. Then, the ECU 8 activates the vacuum pump 45 so as to reduce the internal pressure Pc of the canister 22 and monitors the internal pressure Pc detected by the canister internal pressure sensor 47.

When determining that the internal pressure Pc of the canister 22 is equal to or smaller than a leakage determination threshold value that is predetermined to be smaller than the first threshold value Pa for example after a start of an operation of the vacuum pump 45, the ECU 8 stops the operation of the vacuum pump 45 and determines that leakage does not occur in the purge passage 26 from the canister 22 to the purge valve (Step S110: YES). When determining that the internal pressure Pc is not equal to or smaller than the leakage determination threshold value when the vacuum pump 45 is operated by a predetermined time, on the other hand, the ECU 8 stops the operation of the vacuum pump 45 and determines that leakage occurs in the purge passage 26 (Step S110: NO). Then, the ECU 8 terminates the routine. The ECU 8 opens the switching valve 41 and has a predetermined warning mark display on an instrument panel (not shown) of the vehicle when determining that leakage occurs in the purge passage 26 and terminating the routine.

When determining that leakage does not occur in the purge passage 26 (Step S110: YES), the ECU 8 acquires the internal pressure Ptk of the fuel tank 10 detected by the tank internal pressure sensor 15 (Step S120). Then, the ECU 8 determines whether or not the acquired internal pressure Ptk is larger than the first threshold value Pa that is smaller than the standard atmosphere pressure and is smaller than the second threshold value Pb that is larger than the standard atmosphere pressure (Step S130). When determining that the internal pressure Ptk is larger than the first threshold value Pa and is smaller than the second threshold value Pb (Step S130: YES), the ECU 8 executes a leakage diagnosis process of the vapor passage 24 (Step S140). At Step S140, the ECU 8 closes the switching valve of the key-off pump module 40 so as to cut off the communication between the canister 22 and the atmosphere and opens the sealing valve 30. In this case, the ECU 8 maintains the purge valve 27 in the close state. Then, the ECU 8 activates the vacuum pump 45 again so as to reduce the internal pressure Ptk of the fuel tank 10 via the canister 22 and monitors the internal pressure Ptk of the fuel tank 10 detected by the tank internal pressure sensor 15.

When determining that the internal pressure Ptk of the fuel tank 10 is equal to or smaller than a leakage determination threshold value (that may be the same value for the purge passage 26 or may be different from the value for the purge passage 26) after the start of the operation of the vacuum pump 45, the ECU 8 stops the operation of the vacuum pump 45 and determines that leakage does not occur in the vapor passage 24 (Step S150: YES). Then, the ECU 8 closes the sealing valve 30 and opens the switching valve 41 (Step S160). When determining that the internal pressure Ptk is not equal to or smaller than the leakage determination threshold value when the vacuum pump 45 is operated by a predetermined time, on the other hand, the ECU 8 stops the operation of the vacuum pump 45 and determines that leakage occurs in the vapor passage 24 (Step S150: NO). Then, the ECU 8 terminates the routine. The ECU 8 puts the sealing valve 30 and the switching valve 41 in the normal state and has a predetermined warning mark display on the instrument panel (not shown) of the vehicle when determining that leakage occurs in the purge passage 26 and terminating the routine.

The above described processes are executed so that the diagnosis of leakage in the vapor passage 24 and the purge passage 26 of the vaporized fuel treatment device 20 is completed. After the process of Step S160, in the embodiment, the ECU 8 acquires the internal pressure Ptk of the fuel tank 10 detected by the tank internal pressure sensor 15 again (Step S170) and determines whether or not the acquired internal pressure Ptk is equal to or smaller than the first threshold value Pa (Step S180). Likewise, the ECU 8 executes processes of Steps S170 and S180 when the determination at Step S130 is negative. When determining that the internal pressure Ptk is equal to or smaller than the first threshold value Pa, the ECU 8 executes the learning of the valve opening start position of the sealing valve 30 (Step S190).

At Step S190, the ECU 8 sets initial steps Sint that is an initial command value to the stepper motor 34 of the sealing valve 30 to a predetermined limit valve closing steps S0. Then, the ECU 8 controls the stepper motor 34 so that a rotor of the stepper motor 34 rotates (at high speed) by the set initial steps Sint and stores the initial steps Sint in the RAM as an added steps SA. Further, the ECU 8 controls the stepper motor 34 so that the rotor of the stepper motor 34 rotates by predetermined learning steps SL (for example, several steps). Then, the ECU 8 stores the sum of the added steps SA at the time and the learning steps SL in the RAM as the new added steps SA.

Further, the ECU 8 acquires (calculates) an amount of change ΔPtk in the internal pressure Ptk until a predetermined time (for example, several hundred milliseconds) elapses after the rotor is rotated by the learning steps SL, based on the internal pressure Ptk of the fuel tank 10 detected by the tank internal pressure sensor 15. Then, the ECU 8 determines whether or not an absolute value of the acquired amount of change ΔPtk is equal to or larger than a predetermined threshold value ΔPref (positive value). When determining that the absolute value of the amount of change ΔPtk of the internal pressure Ptk is smaller than the predetermined threshold value ΔPref, the ECU 8 judges that the sealing valve 30 does not start opening (the learning is not completed) so that the internal pressure Ptk of the fuel tank 10 does not substantially change (Step S200: NO) and executes processes of and after Step S170 again.

When determining that the absolute value of the amount of change ΔPtk of the internal pressure Ptk is equal to or larger than the threshold value ΔPref, on the other hand, the ECU 8 judges that the sealing valve 30 starts opening so that the internal pressure Ptk of the fuel tank 10 substantially changes and stores the added steps SA stored in the RAM at the time as a valve opening start steps SS that is a learning value of the valve opening start position in the RAM (Step S200: YES). Then, the ECU 8 closes the sealing valve 30 (Step S210) and terminates the routine. When determining that the internal pressure Ptk is larger than the first threshold value Pa at Step S180, the ECU 8 judges that the execution condition of the learning of the valve opening start position is not satisfied and terminates the routine even if the learning is not completed.

The above described ECU 8 or a controller of the vaporized fuel treatment device 20 is programmed to decrease the internal pressure Ptk of the fuel tank 10 by the vacuum pump 45 via the canister 22 so as to diagnose whether or not leakage occurs in the vapor passage 24 in a state where the switching valve 41 cuts off the communication between the canister 22 and the atmosphere and the sealing valve 30 is opened (Step S140). Further, the ECU 8 executes the learning of the valve opening start position of the sealing valve 30 (Step S190) when the internal pressure Ptk of the fuel tank 10 is equal to or smaller than the first threshold value Pa after the diagnosis of leakage in the vapor passage 24. That is, the internal pressure Ptk of the fuel tank 10 is reduced after the diagnosis of leakage in the vapor passage 24. Further, the learning of the valve opening start position of the sealing valve 30 can be executed when the internal pressure Ptk of the fuel tank 10 is equal to or smaller than the first threshold value Pa that defines the execution condition of the learning of the valve opening start position. Accordingly, the vaporized fuel treatment device 20 enables opportunities for the learning of the valve opening start position of the sealing valve 30 to be effectively increased.

As has been described above, the vaporized fuel treatment device 20 of the disclosure is configured to include the sealing valve 30 that is disposed in the vapor passage 24 between the fuel tank 10 and the canister 22 and is configured to include the valve element 33 that moves forward and backward in the axial direction with respect to the valve seat 32, the switching valve 41 that is configured to cut off the communication between the canister 22 and the atmosphere, the vacuum pump 45 that is configured to reduce the internal pressure of the canister and the ECU 8 that is programmed to control the opening and closing of the sealing valve 30 and executes the learning of the valve opening start position of the sealing valve 30 based on the change in the internal pressure Ptk of the fuel tank 10 when changing the axial distance between the valve element 33 and the valve seat 32. The ECU 8 or the controller works as a vapor passage diagnostic module (Steps S140 and S150) that is programmed to decrease the internal pressure Ptk of the fuel tank 10 by the vacuum pump 45 via the canister 22 so as to diagnose whether or not leakage occurs in the vapor passage 24 in the state where the switching valve 41 cuts off the communication between the canister 22 and the atmosphere and the sealing valve 30 is opened. Further, the ECU 8 works as a learning module (Steps S170, S180 and S190) that is programmed to execute the learning of the valve opening start position of the sealing valve 30 when the internal pressure Ptk of the fuel tank 10 is equal to or smaller than the first threshold value Pa after the diagnosis of leakage in the vapor passage 24. Thus, the opportunities for the learning of the valve opening start position of the sealing valve 30 can be effectively increased.

In the above embodiment, the ECU 8 is programmed to decrease the internal pressure Pc of the canister 22 by the vacuum pump 45 so as to diagnose whether or not leakage occurs in the purge passage 26 connected to the canister 22 in the state where the switching valve 41 cuts off the communication between the canister 22 and the atmosphere and the sealing valve 30 is closed, and decreases the internal pressure Ptk of the fuel tank 10 by the vacuum pump 45 while opening the sealing valve 30 so as to diagnose whether or not leakage occurs in the vapor passage 24, but not limited to this. That is, the leak diagnosis of the purge passage 26 at Step S100 may be omitted in FIG. 2. Further, the routine of FIG. 2 may be terminated in response to the negative determination at Step S130 in FIG. 2 instead of executing the processes of and after Step S170.

The disclosure is not limited to the above embodiments in any sense but may be changed, altered or modified in various ways within the scope of extension of the disclosure. Additionally, the embodiments described above are only concrete examples of some aspect of the disclosure described in Summary and are not intended to limit the elements of the disclosure described in Summary.

INDUSTRIAL APPLICABILITY

The techniques according to the disclosure is applicable to, for example, the field of manufacture of the vaporized fuel treatment device.

The invention claimed is:

1. A vaporized fuel treatment device comprising:

a sealing valve disposed in a vapor passage between a fuel tank and a canister, the sealing valve including a valve element that moves forward and backward in an axial direction with respect to a valve seat;

a cut-off valve configured to cut off a communication between the canister and an atmosphere;

a pressure reduction pump configured to reduce an internal pressure of the canister; and an electronic control unit programmed to decrease an internal pressure of the fuel tank by the pressure reduction pump via the canister so as to diagnose whether or not leakage occurs in the vapor passage in a state where the cut-off valve cuts off the communication between the canister and the atmosphere and the sealing valve is opened, and execute a learning of a valve opening start position of the sealing valve based on a change in the internal pressure of the fuel tank when changing an axial distance between the valve element and the valve seat when the internal pressure of the fuel tank is equal to or smaller than a predetermined value after a diagnosis of leakage in the vapor passage by the vapor passage diagnostic module.

2. The vaporized fuel treatment device according to claim 1, further comprising:

a purge passage connected to the canister, wherein the electronic control unit is programmed to decrease the internal pressure of the fuel tank by the pressure reduction pump so as to diagnose whether or not leakage occurs in the purge passage in a state where the cut-off valve cuts off the communication between the canister and the atmosphere and the sealing valve is closed, and diagnose whether or not the leakage occurs in the vapor passage after a diagnosis of leakage in the purge passage.

3. The vaporized fuel treatment device according to claim 1, wherein the electronic control unit is programmed to diagnose whether or not the leakage occurs in the vapor passage when the internal pressure of the fuel tank is larger than a first threshold value that is smaller than a standard atmosphere pressure and the internal pressure of the fuel tank is smaller than a second threshold value that is larger than the standard atmosphere pressure.

4. The vaporized fuel treatment device according to claim 3, wherein the electronic control unit is programmed to execute the learning of the valve opening start position when the internal pressure of the fuel tank is equal to or smaller than the first threshold value and when the internal pressure of the fuel tank is equal to or larger than the second threshold value, and wherein the predetermined value is the first threshold value.

5. A learning method of a valve opening start position of a sealing valve in a vaporized fuel treatment device, the sealing valve being disposed in a vapor passage between a fuel tank and a canister and including a valve element that moves forward and backward in an axial direction with respect to a valve seat, the vaporized fuel treatment device including the sealing valve, a cut-off valve configured to cut off a communication between the canister and an atmosphere, and a pressure reduction pump configured to reduce an internal pressure of the canister, the method comprising:

decreasing an internal pressure of the fuel tank by the pressure reduction pump via the canister so as to diagnose whether or not leakage occurs in the vapor passage in a state where the cut-off valve cuts off the communication between the canister and the atmosphere and the sealing valve is opened; and executing a learning of a valve opening start position of the sealing valve based on a change in the internal pressure of the fuel tank when changing an axial distance between the valve element and the valve seat when the internal pressure of the fuel tank is equal to or smaller than a predetermined value after a diagnosis of leakage in the vapor passage.

* * * * *